United States Patent [19]

Dheur

[11] Patent Number: 4,512,100

[45] Date of Patent: Apr. 23, 1985

[54] POCKET PISTOL

[75] Inventor: Raymond J. Dheur, Cheratte, Belgium

[73] Assignee: Fabrique Nationale Herstal, Belgium

[21] Appl. No.: 559,002

[22] Filed: Dec. 8, 1983

Related U.S. Application Data

[63] Continuation-in-part of Ser. No. 366,383, Apr. 7, 1982, abandoned.

[30] Foreign Application Priority Data

Aug. 28, 1981 [BE] Belgium ..... 2/59319

[51] Int. Cl.[3] ..... F41C 17/00

[52] U.S. Cl. ..... 42/70 A; 42/70 D

[58] Field of Search ..... 42/7, 70 R, 70 A, 70 D, 42/71 P; 89/148

[56] References Cited

U.S. PATENT DOCUMENTS

| | | | |
|---|---|---|---|
| 1,352,267 | 9/1920 | Hubbell | 42/70 A |
| 1,520,298 | 12/1924 | Mann | 42/70 A |
| 1,523,831 | 1/1925 | Karpinski | 42/70 D |
| 2,529,359 | 11/1950 | Stevens | 89/148 |
| 2,744,448 | 5/1956 | Allen | 42/71 P |
| 3,156,059 | 11/1964 | Crain | 42/71 P |
| 3,492,748 | 2/1970 | Swenson | 42/70 R |
| 4,428,138 | 1/1984 | Seecamp | 42/70 A |

*Primary Examiner*—Charles T. Jordan
*Assistant Examiner*—Ted L. Parr
*Attorney, Agent, or Firm*—Bacon & Thomas

[57] ABSTRACT

A pocket pistol having a sear (13) provided with a downwardly extending protrusion (18), one side of which is engageable by a lug (19) carried at the end of a trigger rod (10), and the other side of which is engageable by a first safety member (24), the latter movable into and out of position to prohibit or permit the movement of sear (13). The sear (13) also includes a lateral finger (16) engageable with either a smaller cut-out portion (28) or a larger cut-out portion (29) on a pivoted second safety member (27), the latter being continuously urged towards a cartridge magazine housing (2) for permitting or prohibiting movement of the sear (13) when a cartridge magazine is, respectively, present or absent from the magazine housing.

2 Claims, 4 Drawing Figures

POCKET PISTOL

This application is a continuation-in-part of application Ser. No. 366,383 filed Apr. 7, 1982 now abandoned.

BACKGROUND OF THE INVENTION

The Karpinski U.S. Pat. No. 1,523,831 discloses a pocket pistol including a body (1) with a housing for a cartridge magazine, a striker (3), a sear (10) pivoted around an axle (10*a*) and controlling the movement of said striker (3) and having a protrusion, a trigger (12), a trigger rod (11), one end of which is coupled with said trigger and the other end of which cooperates with said protrusion. A safety member (14) is rotatably mounted in said housing and means (34) is provided to bring the safety member in one of two positions for permitting or prohibiting the movement of the sear. In this known pistol, the trigger rod and the safety member operate on the sear at different locations thereof.

The Mann U.S. Pat. No. 1,520,298 discloses a pocket pistol including safety means permitting or prohibiting the movement of a sear as a function of a cartridge magazine being present within or absent from the magazine housing.

SUMMARY OF THE INVENTION

An object of the present invention is to provide an improved pistol of the type disclosed in the aforementioned Karpinski U.S. Pat. No. 1,523,831, but combined with a safety means of a type disclosed in the Mann U.S. Pat. No. 1,520,298 in such a unique way that a very compact pistol assembly requiring a minimum of parts is realized.

According to the invention, this object is achieved by providing an improved pocket pistol which includes a body (1) having a cartridge magazine housing (2) for receiving a cartridge magazine (3). The pistol further includes a striker (8) and a sear (13) pivotally mounted about an axle (14) of the body (1) for controlling the movement of the striker (8). The sear (13) includes a lateral finger (16) at one end and a downwardly extending protrusion (18) at its lower part. A trigger (5) is coupled at one end of a trigger rod (10), while the other end of the trigger rod (10) is provided with a lug (19) which continuously engages the protrusion (18).

A first safety member (24) is pivotally mounted about a first pin (22) of the body (1). Levers (25,26) are provided to face the protrusion (18) and function to bring the first safety member (24) into or out of the trajectory of the protrusion (18) for, respectively, prohibiting or permitting movement of the sear (13).

A second safety member (27) is provided and includes one end pivotally mounted about a second pin (23) of the body (1), while the other end, adjacent the lateral finger (16), is provided with both a smaller cut-out portion (28) and a larger cut-out portion (29). A first spring (30) serves to continuously urge the second safety member (27) towards the magazine housing (2) to bring it into a position whereby the smaller cut-out portion (28) is disposed below the lateral finger (16) when the magazine housing (2) is empty, thus prohibiting movement of the sear (13). When the cartridge magazine is disposed in the magazine housing (2), the second safety member (27) is urged into a position wherein the larger cut-out portion (29) is disposed below the lateral finger (16), thereby permitting movement of the sear (13). A second spring (21) is provided for engaging the lateral finger (16) and the lug (19) so as to maintain the sear (13) and the trigger in a rest position. The second spring (21) is mounted around first and second pins (22 and 23).

The aforedescribed structure provides an extremely compact pocket pistol that is particularly characterized by the trigger rod (10) and the first safety member (24) being both engageable on the same protrusion (18) of the sear (13) and, moreover, the second safety member (27) having a particular shape and being pivotally mounted about a second pin (23) which is also used for mounting both the first spring (30) and second spring (21).

BRIEF DESCRIPTION OF THE DRAWINGS

The present invention shall hereinafter be described with reference to the drawings wherein.

DETAILED DESCRIPTION OF THE PREFERRED EMBODIMENTS

Figure 1:
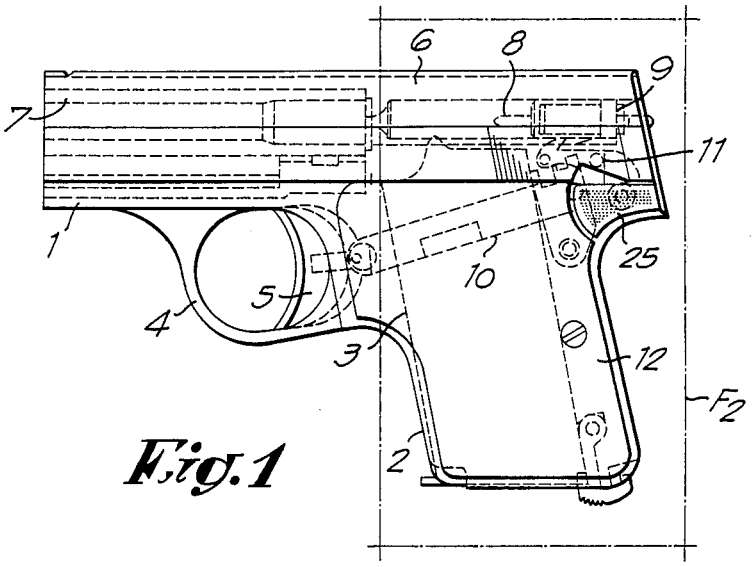
FIG. 1 is a side view of an embodiment of a pocket pistol according to the invention.
Figure 3:
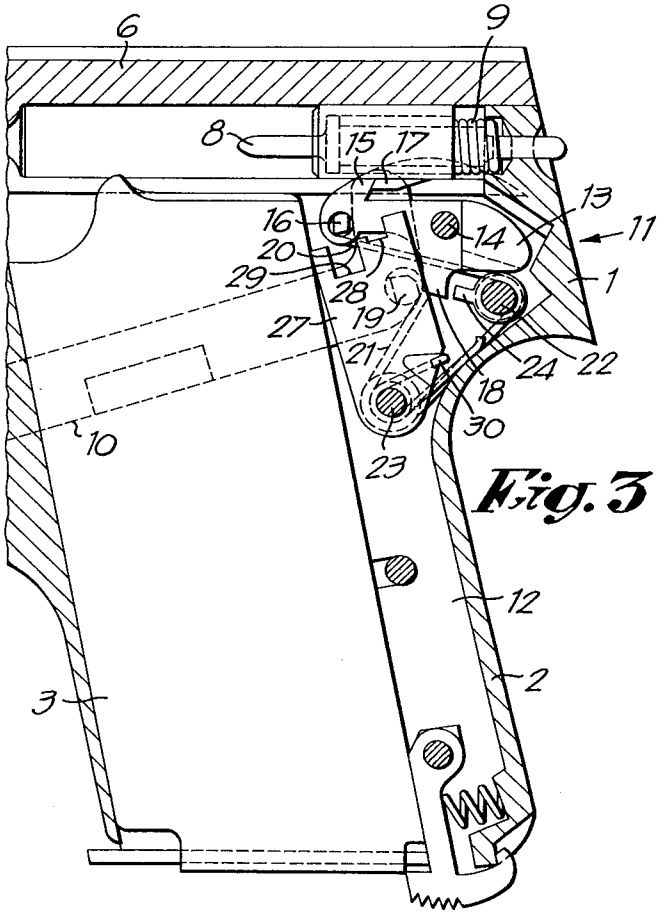
FIGS. 2 and 3 are sectional views on a larger scale of the portion of the pistol indicated by F2 in FIG. 1, the pistol being shown in two characteristic positions.
Figure 2:
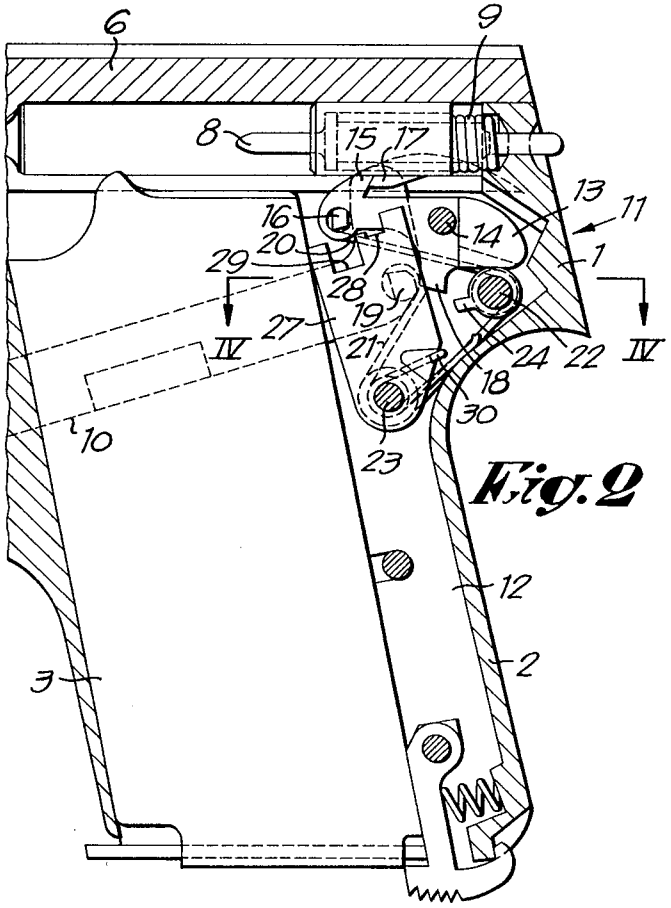

With reference to the drawings, the pocket pistol according to the invention as shown includes a body 1 provided with a hollow hand grip defining a cartridge magazine housing 2 for a cartridge magazine 3, and including a trigger 5 and a guard 4 therefor. The body 1 further supports a slide member 6 surrounding a barrel member 7 that houses a striker 8 which is continuously urged towards the left hand direction, as shown in FIGS. 1-3, by means of a spring 9. The striker 8 is provided at its lower part with a downwardly extending protrusion 17. A trigger rod 10 is provided with a protrusion 19 at one end and is coupled with the trigger 5 at its other end.

A sear mechanism 11, including a sear 13, is pivotally mounted about an axle 14 fixed in the body 1 and includes a beak 15 at its upper end, a lateral finger 16 at its left hand end, as shown in FIGS. 2 and 3, and a downwardly extending protrusion 18 at its lower end. The lateral finger 16 and the lug 19 of the trigger rod 10 are each urged into a high position by respective ends 20 of a spring wire 21 mounted around a first pin 22 and a second pin 23 secured in the body 1. Beak 15 normally engages the protrusion 17 of the striker 8, thus inhibiting the displacement thereof under the action of spring 9, while protrusion 18 of the sear 13 normally continuously engages with the lug 19 of the trigger rod 10.

A first safety member 24 is pivotally secured to the first pin 22 and is provided with operating levers 25 and 26 at its ends. Through an angular displacement of levers 25 and 26, the first safety member 24 may be brought into or out of the trajectory followed by the protrusion 18 of the sear 13 in order to, respectively, prohibit or permit an angular displacement of the sear 13.

Plates 12 extend into the area of the hand grip defining magazine housing 2 and are substantially of an L-shaped configuration, the shorter leg of which extends in the proximity of the trigger, thus increasing the comfort in securing the pistol in hand.

A second safety member 27 is mounted at its lower end for pivotal movement around pin 23 and, at its upper end, is provided with both a smaller cut-out portion 28 and a larger cut-out portion 29. Cut-out portions 28 and 29 are disposed below the lateral finger 16 of the sear 13. A spring 30 serves to continuously urge the safety member 27 into the direction of the housing 2 for the cartridge magazine 3.

Figure 4:
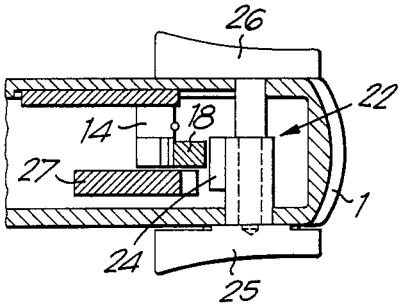
FIG. 4 is a sectional view along the line IV—IV in FIG. 2.

As long as a cartridge magazine 3 is present in the housing 2, the second safety member 27 is in the position shown in FIGS. 2 and 3, wherein the larger cut-out portion 29 of member 27 is disposed below the lateral finger 16 of the sear 13, thus permitting the angular displacement of sear 13 in a counter-clockwise direction. Such displacement is also permitted when the first safety member 24 is in the position shown in FIG. 2, but prohibited if the first safety member 24 is in the position shown in FIG. 3. Safety member 24 is brought into either of the latter two positions through operation of levers 25 and 26 as shown in FIG. 4.

When the housing 2 does not contain a cartridge magazine 3, the second safety member 27 is disposed in the housing 2 by the action of spring 30, thereby placing member 27 in such a position whereby the smaller cut-out portion 28 of member 27 is located below the lateral finger 16, thus prohibiting the angular displacement of the sear 13. Due to the location of the second safety member near the uppermost portion of the housing 2, sear 13 is prohibited from releasing firing pin 8 until the magazine 3 is fully inserted into the housing 2. If an attempt is made to actuate sear 13 during insertion of the magazine 3, the latter is prohibited from being fully inserted because it is blocked by second safety member 27. The larger cut-out portion 29 is disposed beneath the lateral finger 16, thereby permitting actuation of sear 13, only when the magazine 3 is fully inserted into the housing 2. This feature precludes the possibility of firing a cartridge disposed within the chamber when the housing 2 is empty and during insertion of the magazine 3.

If the second safety member 27 and the first safety member 24 are in a position wherein they permit a movement of the sear 13, the latter member is therefore capable of pivoting in the counter-clockwise direction so that the striker 8 may be actuated and released by the trigger rod 10 when the trigger 5 is pulled.

What I claim is:

1. A pocket pistol comprising:

(a) a body including a housing for receiving a cartridge magazine, (b) a striker, (c) a sear mounted on the body for pivotal movement about an axis extending laterally through the body for controlling the movement of the striker, the sear including a lateral finger, a beak extending from a first side of the sear above the axis for engagement with the striker and a downwardly extending protrusion, extending from a second side of the sear opposite the first side and below the axis;

(d) a trigger, (e) a trigger rod having one end coupled with the trigger and the other end including a lug for engaging a first side of the downwardly extending protrusion, (f) a first pin carried by the body, (g) a first safety member mounted for pivotal movement on the first pin, (h) actuating means for moving the first safety member between a first position wherein the safety member is out of the trajectory of the downwardly extending protrusion thereby permitting movement of the sear, and a second position wherein a portion of the safety member is in the trajectory of the downwardly extending protrusion such that it contacts a second side of the protrusion thereby prohibiting movement of the sear, (i) a second pin carried by the body, (j) a second safety member having one end mounted for pivotal movement on the second pin and another end disposed adjacent the lateral finger, the other end including a smaller cut-out portion and a larger cut-out portion, (k) a first spring for continuously urging the second safety member towards the housing to bring the second safety member into a first position wherein the smaller cut-out portion is disposed below the lateral finger when the housing is empty, thereby prohibiting movement of the sear, and into a second position wherein the larger cut-out portion is disposed below the lateral finger when a cartridge magazine is in the housing, thereby permitting movement of the sear, and (l) a second spring of the torsion type extending partially around the first and second pins and having a first end engaging the lateral finger and a second end engaging the lug for maintaining the sear and the trigger in a rest position.

2. A pocket pistol comprising:

(a) a body including a housing for receiving a cartridge magazine;

(b) a striker;

(c) A sear mounted for pivotal movement on the body for controlling the movement of the striker, the sear including a lateral finger and a downwardly extending protrusion;

(d) a trigger;

(e) a trigger rod having one end coupled with the trigger and the other end including a lug continuously engaging the downwardly extending protrusion;

(f) a first pin carried by the body;

(g) a first safety member mounted for pivotal movement on the first pin;

(h) means facing the downwardly extending protrusion for bringing the first safety member into and out of the trajectory of the protrusion to, respectively, prohibit and permit movement of the sear;

(i) a second pin carried by the body;

(j) a second safety member having one end mounted for pivotal movement on the second pin and another end disposed adjacent the lateral finger, the other end including a smaller cut-out portion and a larger cut-out portion;

(k) a first spring for continuously urging the second safety member into a first position wherein the smaller cut-out portion is disposed below the lateral finger when the housing is empty, thereby prohibiting movement of the sear when either the housing is empty or during insertion of the magazine into the housing, and into a second position wherein the larger cut-out portion is disposed below the lateral finger when a cartridge magazine is fully inserted in the housing, thereby permitting movement of the sear; and (l) a second spring engaging the lateral finger and the lug for maintaining the sear and the trigger in a rest position, the second spring being mounted around the first and second pins.

* * * * *